US009908673B2

(12) United States Patent
Rogers et al.

(10) Patent No.: US 9,908,673 B2
(45) Date of Patent: Mar. 6, 2018

(54) BEVERAGE ACCESS RESTRICTING DRINKING ASSEMBLY

(71) Applicants: Eunice Rogers, Jacksonville, FL (US); Carl Rogers, Jacksonville, FL (US)

(72) Inventors: Eunice Rogers, Jacksonville, FL (US); Carl Rogers, Jacksonville, FL (US)

( * ) Notice: Subject to any disclaimer, the term of this patent is extended or adjusted under 35 U.S.C. 154(b) by 0 days.

(21) Appl. No.: 14/974,918

(22) Filed: Dec. 18, 2015

(65) Prior Publication Data

US 2017/0174402 A1 Jun. 22, 2017

(51) Int. Cl.

| | |
|---|---|
| ***B65D 55/14*** | (2006.01) |
| ***A47G 19/22*** | (2006.01) |
| ***B65D 51/16*** | (2006.01) |
| ***G07C 9/00*** | (2006.01) |
| ***B65D 47/28*** | (2006.01) |

(52) U.S. Cl.

CPC ..... *B65D 55/14* (2013.01); *A47G 19/2205* (2013.01); *B65D 47/286* (2013.01); *B65D 51/1644* (2013.01); *G07C 9/00158* (2013.01)

(58) Field of Classification Search

CPC ..... B65D 41/04; B65D 55/02; B65D 55/14; A61J 1/1437; E05B 47/0002; E05B 47/02; G07C 9/00563; B67B 3/00; Y10T 70/5031; Y10T 70/5544; Y10T 70/7107

USPC ..... 220/253, 254.3, 254.8–254.9, 220/259.3–259.4, 295, 303, 713–715, 220/719; 215/311, 322, 359, 387; 222/548, 549, 553, 555, 557; 340/5.2, 340/5.31, 5.52–5.53, 5.73, 5.83; 221/7

See application file for complete search history.

(56) References Cited

U.S. PATENT DOCUMENTS

| | | | | |
|---|---|---|---|---|
| 4,099,642 | A * | 7/1978 | Nergard | A47G 19/2272 220/254.5 |
| 4,141,461 | A * | 2/1979 | LaChance | B65D 47/265 206/1.5 |
| 5,102,002 | A | 4/1992 | Whitley | |
| 5,294,014 | A * | 3/1994 | Wyatt | B65D 47/265 220/253 |
| 5,701,770 | A * | 12/1997 | Cook | E05B 47/02 206/1.5 |
| 6,098,834 | A * | 8/2000 | Hatsumoto | B65D 47/249 220/212.5 |
| 6,382,416 | B1 | 5/2002 | Gainey | |
| 6,626,314 | B1 * | 9/2003 | McHenry | B65D 17/165 220/254.2 |
| 6,786,346 | B1 | 9/2004 | Gurnard et al. | |
| 7,961,914 | B1 * | 6/2011 | Smith | A45C 13/185 340/5.52 |
| 8,237,541 | B2 * | 8/2012 | Wang | B65D 41/04 221/7 |
| 8,328,044 | B1 * | 12/2012 | Iskandar | A47G 19/2272 220/254.3 |
| D675,881 | S | 2/2013 | Wamack, Jr. | |

(Continued)

*Primary Examiner* — Chun Cheung
*Assistant Examiner* — Brijesh V. Patel

(57) ABSTRACT

A secure drinking assembly includes a container that may contain a beverage. A valve is coupled to the container and the valve selectively opens and closes the container. A security lock is coupled to the container. The security lock may be manipulated thereby facilitating the security lock to receive a security code. The security lock actuates the valve to selectively open the container when the security lock receives the security code.

9 Claims, 4 Drawing Sheets

(56) References Cited

U.S. PATENT DOCUMENTS

| | | | | |
|---|---|---|---|---|
| 8,464,895 | B2 * | 6/2013 | Gilbert | A47G 19/2272 215/307 |
| 8,640,904 | B2 * | 2/2014 | Steininger | B65D 47/265 220/253 |
| 2008/0302794 | A1 | 12/2008 | Wagner et al. | |
| 2009/0071208 | A1 * | 3/2009 | Wang | E05B 47/0603 70/277 |
| 2013/0015187 | A1 | 1/2013 | Tate et al. | |
| 2013/0175234 | A1 | 7/2013 | Mackenzie et al. | |
| 2013/0307683 | A1 | 11/2013 | Greenberg et al. | |
| 2014/0305940 | A1 | 10/2014 | Schmidt et al. | |

* cited by examiner

BEVERAGE ACCESS RESTRICTING DRINKING ASSEMBLY

BACKGROUND OF THE DISCLOSURE

Field of the Disclosure

The disclosure relates to drinking devices and more particularly pertains to a new drinking device for inhibiting an unauthorized user from accessing a beverage in a container.

SUMMARY OF THE DISCLOSURE

An embodiment of the disclosure meets the needs presented above by generally comprising a container that may contain a beverage. A valve is coupled to the container and the valve selectively opens and closes the container. A security lock is coupled to the container. The security lock may be manipulated thereby facilitating the security lock to receive a security code. The security lock actuates the valve to selectively open the container when the security lock receives the security code.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
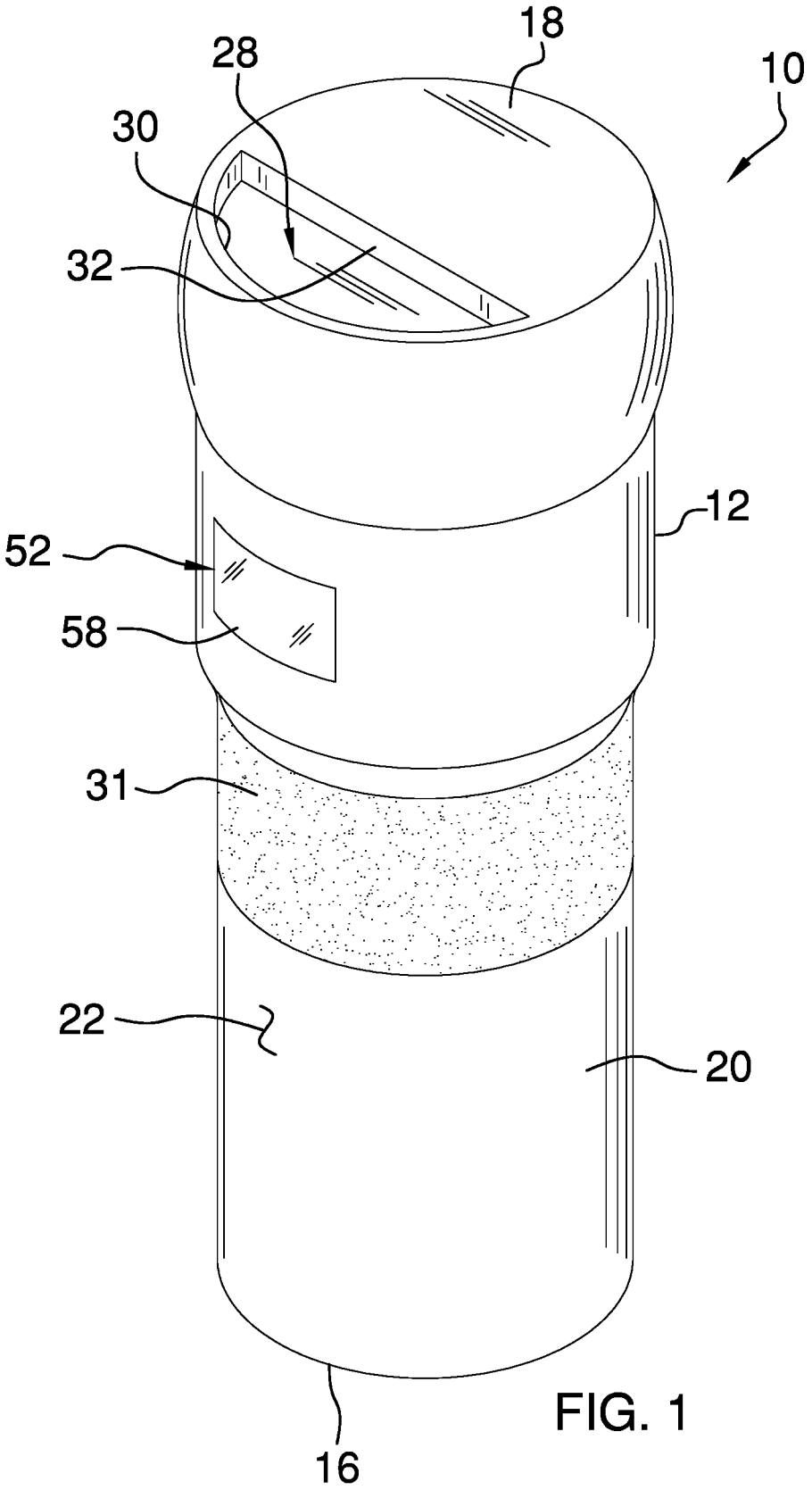
FIG. 1 is a perspective view of a secure drinking assembly according to an embodiment of the disclosure.
Figure 2:
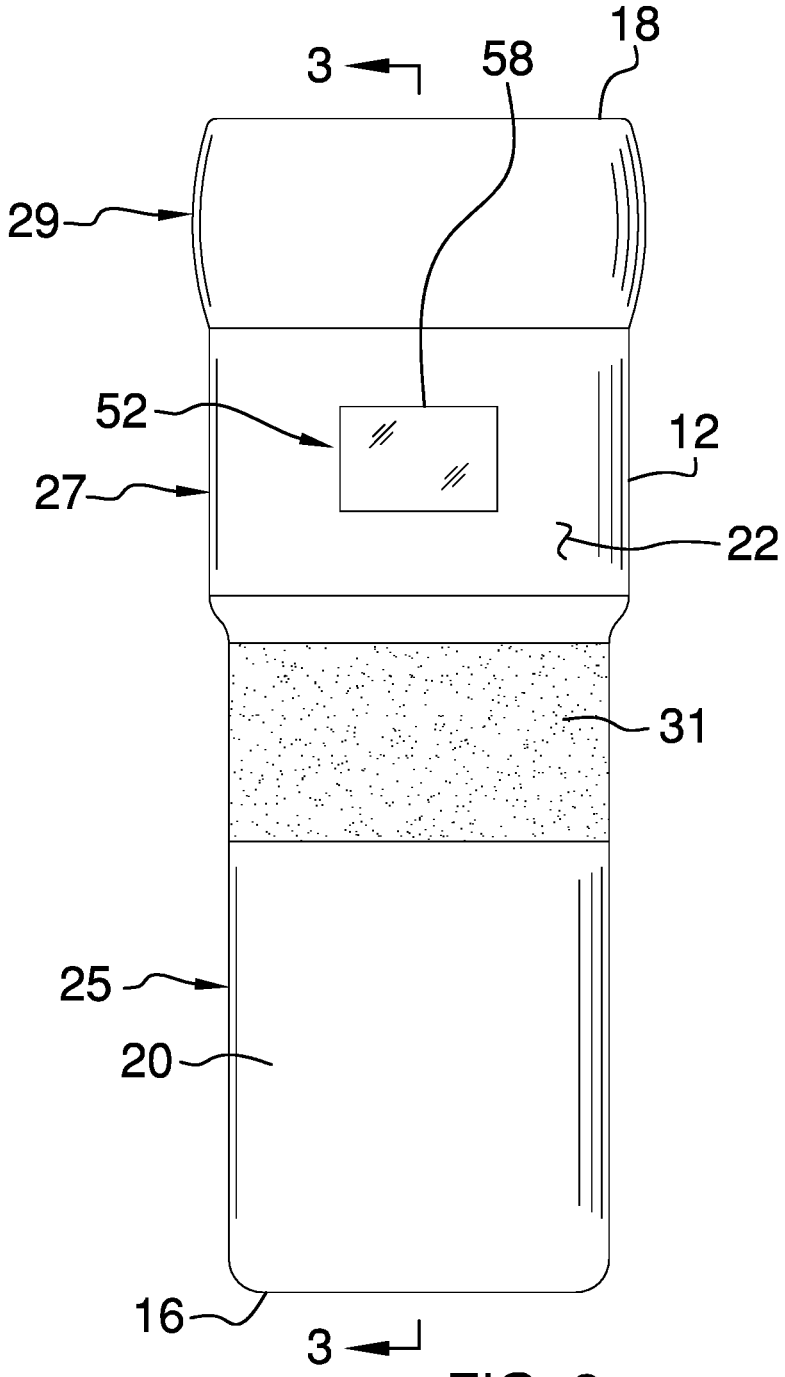
FIG. 2 is a front view of an embodiment of the disclosure.
Figure 3:
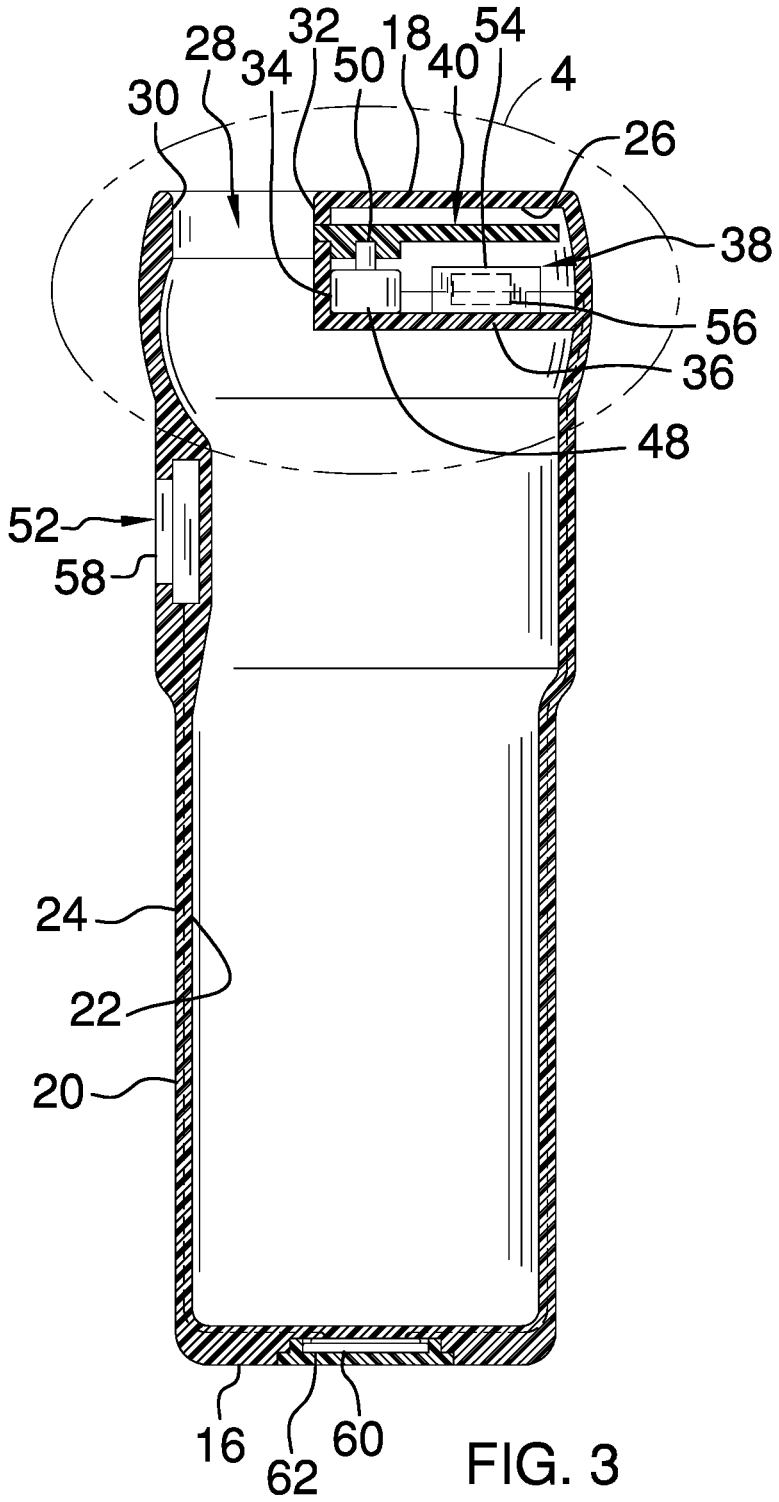
FIG. 3 is a cross sectional view taken along line 3-3 of FIG. 2 of an embodiment of the disclosure in an open position.
Figure 4:
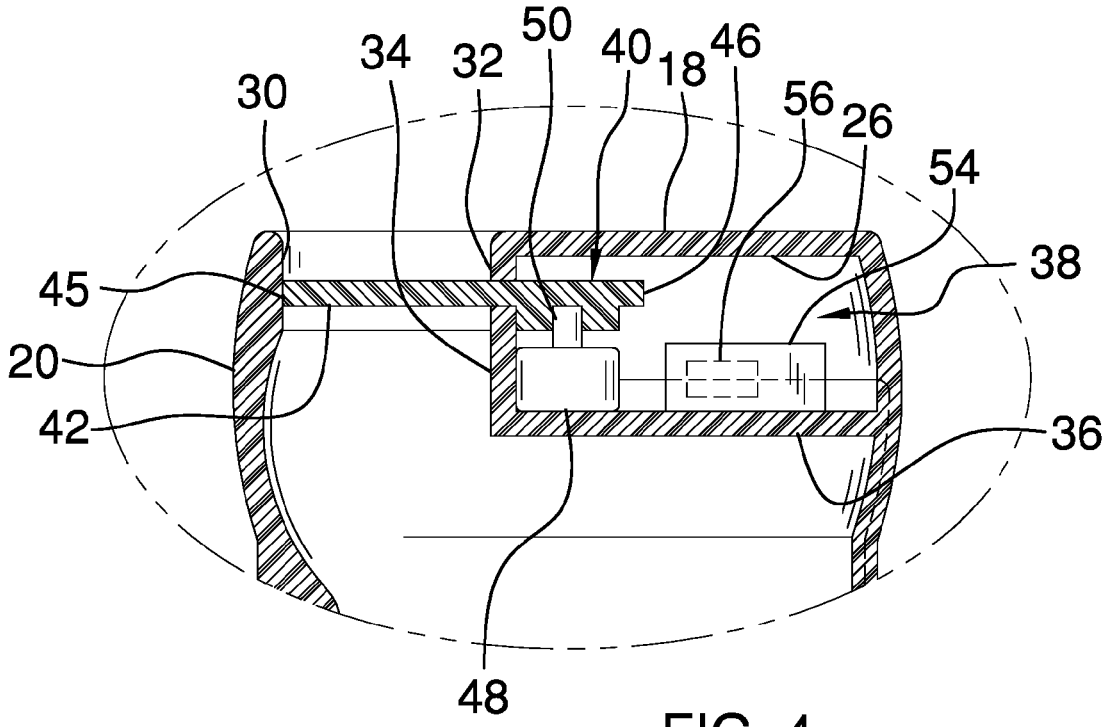
FIG. 4 is a cross sectional view taken along line 3-3 of FIG. 2 of an embodiment of the disclosure in a closed position.
Figure 5:
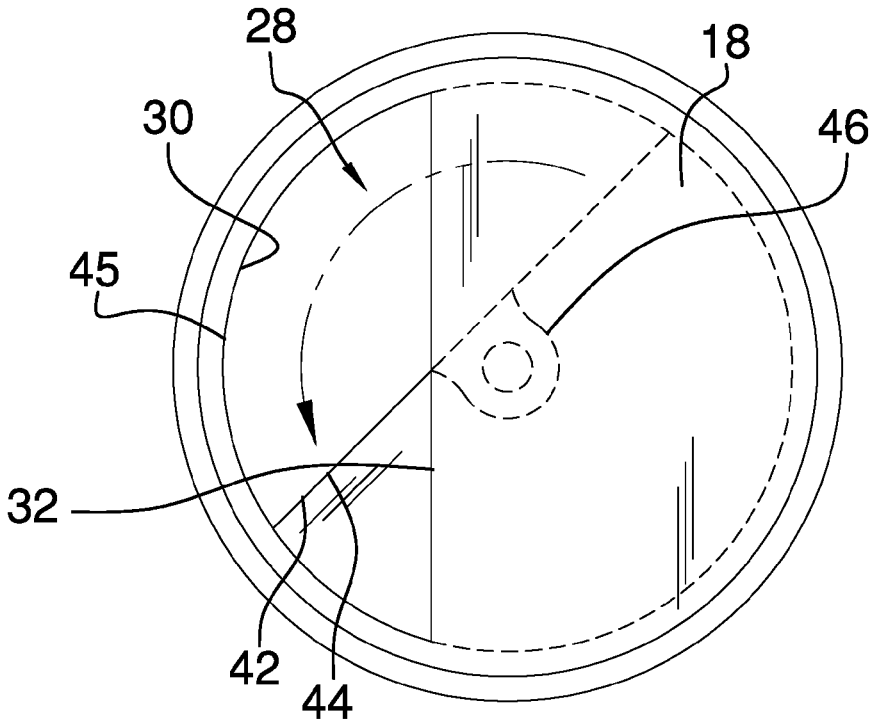
FIG. 5 is a top view of an embodiment of the disclosure.

With reference now to the drawings, and in particular to FIGS. 1 through 5 thereof, a new drinking device embodying the principles and concepts of an embodiment of the disclosure and generally designated by the reference numeral 10 will be described.

As best illustrated in FIGS. 1 through 5, the secure drinking assembly 10 generally comprises a container 12 that may contain a beverage 14. The container 12 has a bottom end 16, a top end 18 and an outer wall 20 extending between the bottom end 16 and the top end 18. The outer wall 20 has an inner surface 22 and an outer surface 24. The top end 18 has a bottom surface 26. The top end 18 has an opening 28 extending into an interior of the container 12. The opening 28 may release the beverage 14 from the container 12.

The outer wall 20 may have a lower portion 25, a middle portion 27 and a top portion 29. The middle portion 27 may have a diameter that is greater than a diameter of the lower portion 25. The top portion 29 may have a diameter that is greater than a diameter of the middle portion 28. A grip 31 may be coupled to the outer surface 24. The grip 31 may be continuous such that the grip 31 extends around the outer wall 20. The grip 31 may be positioned adjacent to an intersection of the middle portion 27 and the lower portion 25.

The outer wall 20 may be curved such that the container 12 has a cylindrical shape. The opening 28 has a first bounding edge 30 and a second bounding edge 32. The first bounding edge 30 may be concavely arcuate with respect to the second bounding edge 32. Thus, the opening 28 may have a semi-circular shape.

The opening 28 has an inner bounding surface 34 and the inner bounding surface 34 is coextensively aligned with the second bounding edge 32. The inner bounding surface 34 extends downwardly from the bottom surface 26 of the top end 18. The container 12 has an internal wall 36 extending between the inner bounding surface 34 and the inner surface 22 of the outer wall 20. Thus, the internal wall 36 defines a space 38 within the container 12. The space 38 is fluidly discrete from the interior of the container 12.

A valve 40 is coupled to the container 12 and the valve 40 selectively opens and closes the container 12. The valve 40 comprises a lid 42 that is rotatably coupled to the bottom surface 26 of the top end 18. The lid 42 is rotatable into a closed position having the lid 42 closing the opening 28. Thus, the lid 42 inhibits the beverage 14 from passing through the opening 28. The lid 42 is rotatable in an open position having the lid 42 exposing the opening 28. Thus, the lid 42 may allow the beverage 14 to pass through the opening 28.

The lid 42 has a first edge 44 and a second edge 45. The second edge 45 may be concavely arcuate with respect to the first edge 44. Thus, the lid 42 may have a semi-circular shape. A lobe 46 extends away from the first edge 44. The lobe 46 extends through the inner bounding surface 34 such that the lobe 46 is positioned within the space 38.

A motor 48 is positioned within the space 38 and the motor 48 is aligned with the lobe 46. The motor 48 selectively rotates in a first direction. The motor 48 is biased to rotate in a second direction. The motor 48 may comprise an electrical motor or the like.

A shaft 50 is rotatably coupled to the motor 48 such that the motor 48 rotates the shaft 50 when the motor 48 is turned on. The shaft 50 engages the lobe 46. The lid 42 is rotated into the open position when the motor 48 rotates in the first direction. The lid 42 is rotated into the closed position when the motor 48 rotates in the second direction. The lid 42 is aligned with the opening 28 when the lid 42 is rotated into the closed position. The lid 42 is rotated about an axis extending through the top end 18 and the bottom end 16 of the container 12.

A security lock 52 is provided. The security lock 52 is coupled to the container 12. The security lock 52 may be manipulated thereby facilitating the security lock 52 to receive a security code. The security lock 52 actuates the valve 40 to selectively open the container 12 when the security lock 52 receives the security code.

The security lock 52 comprises a processor 54 that is positioned within the space 38. The processor 54 is electrically coupled to the motor 48 such that the processor 54 selectively actuates the motor 48 to rotate in the first direction. The processor 54 includes an electronic memory 56. The electronic memory 56 may store a pre-determined finger print. The processor 54 may comprise an electronic processor or the like.

A finger print scanner 58 is coupled to the outer surface 24 of the outer wall 20 and the finger print scanner 58 may read a finger print. The finger print scanner 58 is electrically coupled to the processor 54. Thus, the processor 54 actuates the motor 48 to rotate in the first direction when the finger print scanner 58 reads a finger print that corresponds to the pre-determined finger print stored in the electronic memory 56. Thus, the beverage 14 may be consumed. The finger print scanner 58 may comprise an electronic finger print scanner or the like.

A power supply 60 is positioned within the container 12. The power supply 60 is electrically coupled to the processor 54. The power supply 60 comprises at least one battery 62. The power supply 60 may be positioned within the bottom end of the container.

In use, the container 12 is gripped such that a finger abuts the finger print scanner 58. The finger print scanner 58 reads the finger print on the finger. The processor 54 actuates the motor 48 to rotate in the first direction when the finger print on the finger matches the pre-determined finger print stored in the electronic memory 58. The beverage 14 is consumed while the finger abuts the finger print scanner 58. The motor 48 rotates in the second direction when the finger is removed from the finger print scanner 58. The lid 42 closes the opening in the container 12. Thus, the beverage 14 is inhibited from being contaminated or consumed by someone other than an authorized user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A secure drinking assembly comprising:

a container being configured to contain a beverage;

a valve being coupled to said container, said valve selectively opening and closing said container;

a security lock being coupled to said container, said security lock being configured to be manipulated thereby facilitating said security lock to receive a security code, said security lock actuating said valve to selectively open said container when said security lock receives the security code and wherein said container has a bottom end, a top end and an outer wall extending between said bottom end and said top end, said outer wall having an inner surface and an outer surface, said top end having a bottom surface, said top end having an opening extending into an interior of said container wherein said opening is configured to release the beverage from said container, said opening having an inner bounding surface, said container having an internal wall extending between said inner bounding surface and said inner surface of said outer wall to define a space within said container, said space being fluidly discrete from an interior of said container.

2. The secure drinking assembly according to claim 1, wherein said valve comprises a lid being rotatably coupled to said bottom surface of said top end, said lid being rotatable into a closed position having said lid closing said opening wherein said lid is configured to inhibit the beverage from passing through said opening, said lid being rotatable in an open position having said lid exposing said opening wherein said lid is configured to allow the beverage to pass through said opening.

3. The secure drinking assembly according to claim 2, wherein said lid has a first edge, said lid having a lobe extending away from said first edge, said lobe extending through said inner bounding surface such that said lobe is positioned within said space.

4. The secure drinking assembly according to claim 3, further comprising a motor being positioned within said space, said motor being aligned with said lobe, said motor selectively rotating in a first direction, said motor being biased to rotate in a second direction.

5. The secure drinking assembly according to claim 4, further comprising a shaft being rotatably coupled to said motor such that said motor rotates said shaft when said motor is turned on, said shaft engaging said lobe, said lid being rotated into said open position when said motor rotates in said first direction, said lid being rotated into said closed position when said motor rotates in said second direction.

6. The secure drinking assembly according to claim 1, wherein:

said container has a space;

a motor; and said security lock comprises a processor being positioned within said space, said processor being electrically coupled to said motor such that said processor selectively actuates said motor to rotate in a first direction, said processor including an electronic memory, said electronic memory being configured to store a pre-determined finger print.

7. The secure drinking assembly according to claim 6, further comprising:

said container having an outer wall, said outer wall having an outer surface; and a finger print scanner being coupled to said outer surface of said outer wall wherein said finger print scanner is configured to read a finger print, said finger print scanner being electrically coupled to said processor such that said processor actuates said motor to rotate in said first direction when said finger print scanner reads a finger print that corresponds to the pre-determined finger print stored in said electronic memory thereby facilitating the beverage to be consumed.

8. The secure drinking assembly according to claim 6, further comprising a power supply being positioned within said container, said power supply being electrically coupled to said processor, said power supply comprising at least one battery.

9. A secure drinking assembly comprising:

a container being configured to contain a beverage, said container having a bottom end, a top end and an outer wall extending between said bottom end and said top end, said outer wall having an inner surface and an outer surface, said top end having a bottom surface, said top end having an opening extending into an interior of said container wherein said opening is configured to release the beverage from said container, said opening having an inner bounding surface, said container having an internal wall extending between said inner bounding surface and said inner surface of said outer wall to define a space within said container, said space being fluidly discrete from said interior of said container; and a valve being coupled to said container, said valve selectively opening and closing said container, said valve comprising:

a lid being rotatably coupled to said bottom surface of said top end, said lid being rotatable into a closed position having said lid closing said opening wherein said lid is configured to inhibit the beverage from passing through said opening, said lid being rotatable in an open position having said lid exposing said opening wherein said lid is configured to allow the beverage to pass through said opening, said lid having a first edge, said lid having a lobe extending away from said first edge, said lobe extending through said inner bounding surface such that said lobe is positioned within said space, a motor being positioned within said space, said motor being aligned with said lobe, said motor selectively rotating in a first direction, said motor being biased to rotate in a second direction, and a shaft being rotatably coupled to said motor such that said motor rotates said shaft when said motor is turned on, said shaft engaging said lobe, said lid being rotated into said open position when said motor rotates in said first direction, said lid being rotated into said closed position when said motor rotates in said second direction; and a security lock being coupled to said container, said security lock being configured to be manipulated thereby facilitating said security lock to receive a security code, said security lock actuating said valve to selectively open said container when said security lock receives the security code, said security lock comprising:

a processor being positioned within said space, said processor being electrically coupled to said motor such that said processor selectively actuates said motor to rotate in said first direction, said processor including an electronic memory, said electronic memory being configured to store a pre-determined finger print, a finger print scanner being coupled to said outer surface of said outer wall wherein said finger print scanner is configured to read a finger print, said finger print scanner being electrically coupled to said processor such that said processor actuates said motor to rotate in said first direction when said finger print scanner reads a finger print that corresponds to the pre-determined finger print stored in said electronic memory thereby facilitating the beverage to be consumed, and a power supply being positioned within said container, said power supply being electrically coupled to said processor, said power supply comprising at least one battery.

* * * * *